United States Patent [19]

Wagner et al.

[11] 4,441,879

[45] Apr. 10, 1984

[54] OIL AND GAS BURNER FOR INSTALLATION IN HEATING AND STREAM-PRODUCING BOILERS

[75] Inventors: Ulrich Wagner, Hamburg; Winfried Buschulte, Neckarsulm, both of Fed. Rep. of Germany

[73] Assignees: M.A.N. Maschinenfabrik Augsburg-Nurnberg, Augsburg; Deutsche Forschungs- und Versuchsanstalt fur Luft- und Raumfahart E.V., Cologne, both of Fed. Rep. of Germany

[21] Appl. No.: 303,640

[22] Filed: Sep. 18, 1981

[30] Foreign Application Priority Data

Sep. 22, 1980 [DE] Fed. Rep. of Germany ..... 3035707

[51] Int. Cl.[3] ..... F23D 17/00

[52] U.S. Cl. ..... 431/284; 431/285; 431/265; 431/353; 431/116

[58] Field of Search ..... 431/265, 284, 171, 187, 431/116, 285, 353, 354; 239/422, 424

[56] References Cited

U.S. PATENT DOCUMENTS

| | | | |
|---|---|---|---|
| 2,672,190 | 3/1954 | Schumann | 431/284 X |
| 2,857,961 | 10/1958 | Brown et al. | 431/116 |
| 3,367,384 | 2/1968 | Voorheis | 431/285 X |
| 4,115,050 | 9/1978 | Gerwin | 431/265 X |
| 4,308,007 | 12/1981 | Buschulte | 431/265 X |

FOREIGN PATENT DOCUMENTS

| | | | |
|---|---|---|---|
| 2843002 | 4/1980 | Fed. Rep. of Germany | 431/116 |
| 52-45738 | 4/1977 | Japan | 431/265 |
| 819977 | 9/1959 | United Kingdom | 431/116 |

*Primary Examiner*—Samuel Scott
*Assistant Examiner*—Kenichi Okuno
*Attorney, Agent, or Firm*—Salter & Michaelson

[57] ABSTRACT

An oil burner for installation in heating or steam-raising boilers. The burner has downstream of an oil atomization device a plate having a single opening or a plurality of openings arranged in a ring coaxially of the oil atomising device, the plate opening or openings being the only throughway for combustion air. A mixing tube is arranged coaxially at a distance downstream of the plate. The mixing tube has a diameter greater than the diameter of the single opening or of a circle which encloses the plurality of openings in the plate. A flame tube positioned coaxially around the mixing tube has a length such that the flow of combustion gases downstream of the mixing tube is applied against the internal wall of the flame tube. To enable the burner alternatively to be used for burning gaseous fuel at will, an annular chamber for the supply of a gaseous fuel and having gas outlet openings in the region of the plate opening or openings is also provided downstream of and close to the plate. By the use of substantially similar component parts it is possible to manufacture a burner solely for gaseous fuel comprising the plate having a coaxial single opening or a plurality of openings, a throughway for the combustion air and an annular chamber downstream of and close to the plate for the supply of the gaseous fuel and having gas outlet openings in the vicinity of the plate opening or openings.

13 Claims, 7 Drawing Figures

OIL AND GAS BURNER FOR INSTALLATION IN HEATING AND STREAM-PRODUCING BOILERS

BACKGROUND OF THE INVENTION

The invention relates to oil burners of the type comprising an oil atomizer device; a plate arranged downstream of the oil atomiser device and having at least one opening therein providing a throughway for the atomized oil and also being the sole throughway for combustion air; a mixing tube arranged co-axially at a distance downstream of said plate and having a diameter greater than the diameter of a circle bounding the throughway in said plate, and a flame tube co-axially surrounding said mixing tube and having a length such that the flow of combustion gases downstream of said mixing tube is applied against the inner wall of said flame tube. The invention also relates to gaseous fuel burners of the type comprising an air supply chamber and a gaseous fuel supply means having outlet openings through which the gaseous fuel is introduced into the stream of combustion air. The burners are for installation in heating and steam producing boilers.

DESCRIPTION OF THE PRIOR ART

Oil burners of the aforesaid type are described in U.S. Pat. Nos. 4,308,007 and 4,364,725, and Fed. Republic of Germany Specification Nos. DE-OS 27 00 671 and 27 51 524 and DE-GM 79 19 481 and are characterised by simple construction, a high degree of reliability in operation and good combustion.

It is an object of the invention to further develop an oil burner of the aforesaid type in such a way that it can be operated with fuel oil or gaseous fuel at will without the necessity of interchanging component parts when changing from one mode of operation to another.

SUMMARY OF THE INVENTION

This object is solved according to the invention by providing in an oil burner of the aforesaid type downstream of and close to said plate an annular chamber for the supply of gaseous fuel and having gas outlet openings in the region of said diaphragm opening.

It is also possible to manufacture burners solely for burning gaseous fuel, said gaseous fuel burners of the aforesaid type also including as a throughway for the combustion air a plate which closes the air supply chamber at its downstream end except for at least one opening in said plate and, for the supply of gaseous fuel, an annular chamber downstream of and close to said plate, said chamber having gas outlet openings in the region of said plate opening.

Burners according to the invention enable operation with fuel oil or gaseous fuel at will. Also the fabrication and storage of burners solely for burning oil, combined oil-gas burners, and burners solely for burning gaseous fuel are simplified to a high degree.

BRIEF DESCRIPTION OF THE DRAWINGS

Several embodiments of a burner in accordance with the invention are illustrated by way of example in the accompanying drawings and are described in detail in the following with reference to the drawings.

In the drawings.

DESCRIPTION OF THE PREFERRED EMBODIMENTS

Figure 1:
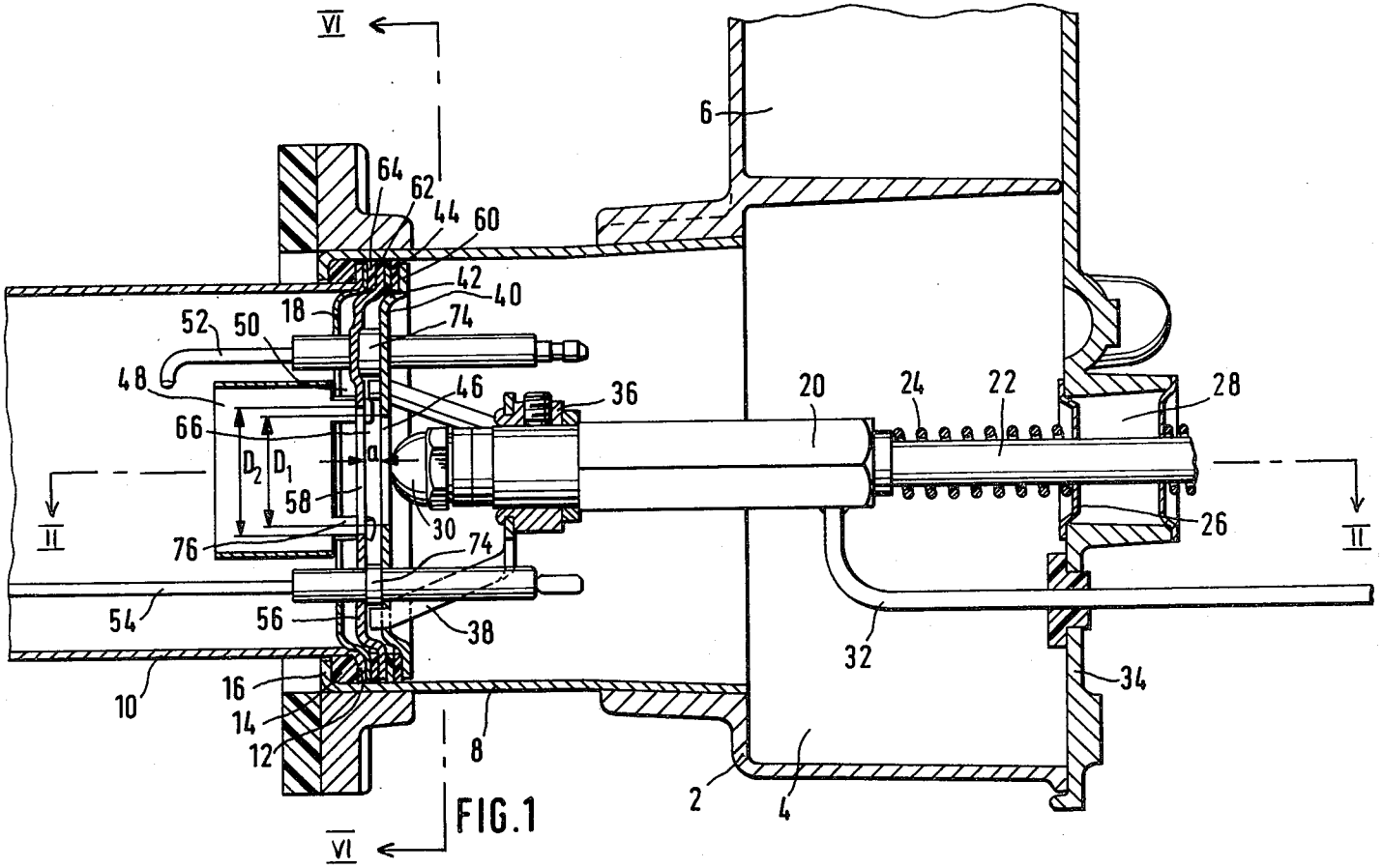
FIG. 1 shows a longitudinal section through the most important components of a burner according to the invention.
Figure 2:
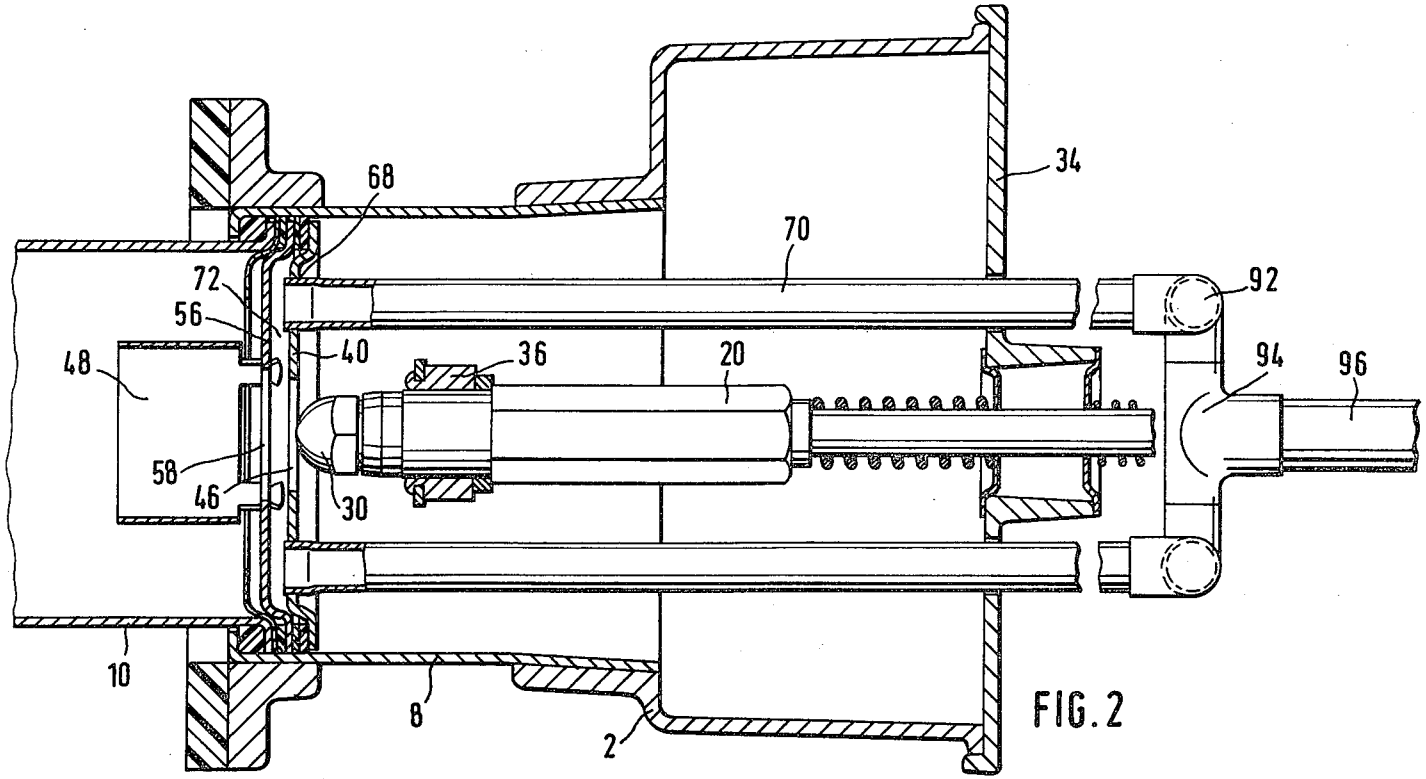
FIG. 2 shows a section along the line II—II in FIG. 1.

The burner as illustrated in FIGS. 1 and 2 corresponds in its basic construction with known oil burners such as are illustrated and described in the aforesaid U.S. Patents and Fed. Republic of Germany Specifications Nos. DE-OS 27 00 671 and 27 51 524 and in DE-GM 79 19 481.

The burner illustrated herein has a housing denoted as a whole by 2, which enclose an air supply chamber 4 into which air is fed from a blower arranged in a blower-chamber 6 situated above the chamber 4, as viewed in FIG. 1. The housing 2 encloses a supporting tube 8 into which a flame tube 10 is inserted, being applied by means of an outer flange 12 against an inner flange 16 of the supporting tube 8 through a packing 14. At the end of the flame tube 10 there is situated an oil-retaining flange 18, rigidly attached to the flange 12, which retains any oil dripping into the flame tube 10. An oil supply tube 20 is arranged coaxially in the supporting tube 8 and carries at its rear end a tube 22 around which there is arranged a compression spring 24 which is supported at one end against the end of the oil supply tube 20 and against a thrust washer 26 in an opening 28 in the housing. A pressure spray gun nozzle 30 is screwed into the oil supply tube 20 at the front end thereof. The tube 22 may form the oil supply tube. If an oil pre-heating system is arranged it is possible to feed the current supply for the pre-heating element through this tube. The oil is then fed through a separate conduit 32 led into the oil supply tube at the side, as may be seen in FIG. 1, which passes through an additional bore in the rear wall 34 of the housing.

The oil supply is carried by a ring 36 which is attached by means of a supporting rib 38 to a plate 40 which is designed to be substantially plane and which is offset at its periphery in the axial direction from the plane of the central region. This offset 42 at the circumference of the circular disc serves for the centering of a packing 44, by means of which the plate 40 is sealed at its circumference in such a way that no air can pass through there.

A plate opening 46 is provided centrally in the plate 40 and is thus also situated concentric with the axis of the pressure spray gun nozzle 30. The opening 46 in the diaphragm is the only throughway for combustion air. The diameter of the opening 46 in the plate depends on the rated throughput of the burner. The fraction of combustion air is determined by this. In front of the plate 40 there is also provided, coaxially with the opening 46 in the diaphragm 40, a mixing tube 48 which has an inlet cross-section 50 at the end facing towards the plate through which hot combustion gases from the rear of the flame front which is formed in the flame tube 50 can recirculate. An ignition electrode pair 52 is provided for ignition and is led through the diaphragm 40. An ionisation electrode 54 is also provided and is also led through the diaphragm 40.

The ignition electrodes 52 are situated with their points downstream of the mixing tube 48. This mode of construction corresponds to that according to Fed. Republic of Germany Specification No. DE-GM 79 19 481. The ignition electrodes may however alternatively be arranged in the region of the opening 46 as is illustrated and described in U.S. Pat. No. 4,308,007 and Fed. Republic of German Specification No. DE-OS 27 00 671.

The burner described is also provided in the usual way with a driving motor for a fan wheel blower which in general also drives an oil pressure pump. In addition there is also provided an automatic firing device of the usual type as well as an ignition transformer. A magnet valve is preferably provided between the oil pump and the spray nozzle.

The blower may also be designed, instead of with an axis of rotation parallel to the axis of the nozzle as described, with the axis of rotation at right angles to the nozzle axis, in a known manner.

The mixing tube 48 may be designed to have solid walls as illustrated. In order to prevent pulsations it may be perforated, for example in the forward region or provided in any manner with openings which decrease or suppress the pulsations but do not interfere with recirculation of the hot gases.

The flame tube 10 has a length such that it is possible to ensure that the current of combustion gas downstream of the mixing tube 48 is applied against the inner wall of the flame tube. In this way it is ensured that a stable recirculation can be established in the neighborhood of the mixing tube.

In order also to be able to operate a fuel oil-operated burner of the known type as described above with gaseous fuel at will there is provided according to the invention, downstream of the diaphragm 40 and at a distance from it, a second plate 56 which is provided with a plate opening 58 at its centre and coaxial with the axis of the nozzle 30. The diameter $D_2$ of the plate opening 58 is equal to or greater than the diameter $D_1$ of the plate opening 46. An ejector effect occurs with equal diameters since the air stream may contract in area behind the plate opening 46. The plate opening 58 therefore preferably has a diameter $D_2$ which is greater than the diameter $D_1$ of the plate opening 46.

Instead of a single hole plate opening as illustrated in the drawing a multi-hole plate may be provided. With the multi-hole plate opening, one plate hole is coaxial with the axis of the nozzle while the remaining plate holes are arranged symmetrically around the central plate hole. Multi-hole plate openings of this type may have an advantageous effect with respect to the intermixture of air and gas and the flame stability. They may also lead to a decrease in noise, especially when operating with fuel oil. Multi-hole plates of this type are described in more detail in Fed. Republic of Germany Specification No. DE-OS 29 18 416.

Figure 6:
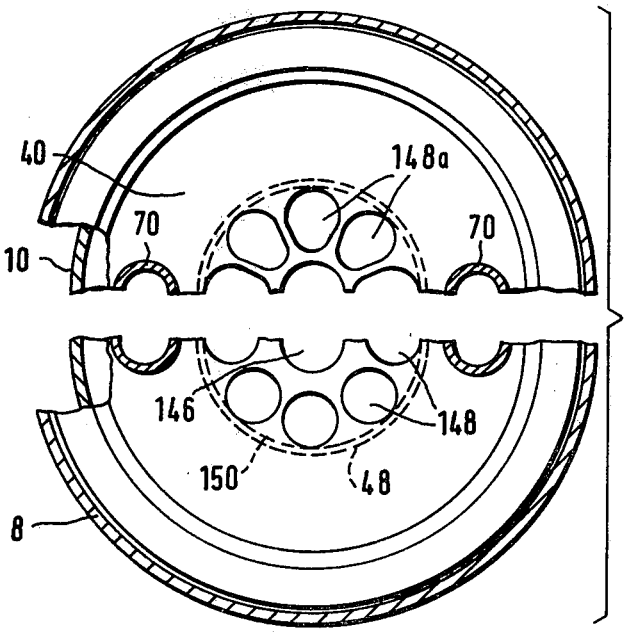
FIG. 6 shows in a section along the line VI—VI in FIG. 1, a design of the plate with a multi-hole plate opening.

An embodiment of such a multi-hole plate is illustrated in FIG. 6. The plate throughput here has a central opening 146 through which oil is supplied by the nozzle. Around the central opening 146 there is arranged a plurality of additional openings 148 for the throughput of air and, in particular, in such a way that they are situated within a circumscribing circle 150 defining a surface circumscribed by the projection of the internal cross-section of the mixing tube 48. The flame tube 10 and the supporting tube 8 are also shown in FIG. 6. The outer openings 148*a* for throughput of air have a cross-section elongated in the radial direction. This cross-section may, for example, have the form of a compressed drop as is shown in the drawing. It is also possible to provide an approximately trapezoidal form.

Figure 7:
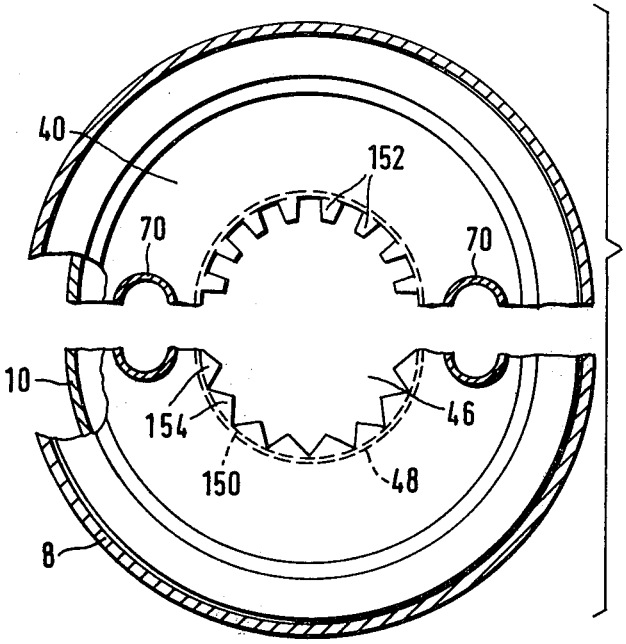
FIG. 7 shows, in section along the line VI—VI in FIG. 1, two alternative designs of the plate with plate openings having a toothed or serrated edge.

Another possibility for the improvement of the intermixture of air and gas and of improvement of the flame stability during operation with a combustible gas is illustrated in FIG. 7.

Here the plate opening 46 is provided at its edge with radial projections in each case. These projections may be designed as shown in FIG. 7 above the horizontal centre-line therein as radially projecting teeth 152. The part of FIG. 7 below the horizontal centre-line illustrates a design in the form of serrations 154. The teeth or serrations are here provided symmetrically round the circumference of the plate opening 46, that is with equal radial extension and equal angular separation. It is, of course, also possible to provide teeth of other shape or to serrate the edge of the plate opening in other ways.

The plate 56 may also consist of a circular plate and may be substantially identical with the plate 40. The edges 60 and 62 of the two diaphragms 40 and 56 are equiaxial and are sealed against one another by means of packings 44. The edge 62 of the plate 56 is applied against the flange 12 of the flame tube 10 through a packing 64. The packing or packings 44 between the edges 60 and 62 of the plates 40 and 56 determine the distance a between the two plates 40 and 56 and thus the axial dimension of the annular chamber 72 formed between the two plates.

As is illustrated in FIG. 2, the plate 40 is provided with two bores 68 in a plane which passes substantially horizontally through the plate, into which said bores the ends of the gas supply tubes 70 are inserted. The ends of the tubes may here be attached by expansion within the respective bores 68. The tubes 70 extend through the housing substantially parallel to the axis of the pressure spray nozzle 30. They may either be led together within the housing and then be led through a single outlet in the rear wall 34 of the housing or, as is illustrated in the drawing, may both be led independently through the housing wall 34 and may be provided on its outer side with angles or curves 92 and joined by means of a T-piece 94 which is provided with a hose coupling 96. This is connected in the usual way with a gas connection line and, in particular, preferably via a magnetic valve.

With the oil supply switched off and the gas supply switched on a reduced pressure is produced behind the plate opening 46 by the air stream passing through this opening, by means of which reduced pressure gas is sucked in from the annular chamber 72. The mixture formed in this way is ignited by means of the electrodes 52 and then burns inside the flame tube 10. Operation is monitored, as with oil operation, by means of the ionization electrode 54.

In order to change over from one mode of operation to the other it is only necessary to bring about one switch-over, for example to interchange two plugs provided for the mode of operation in question in such a way that the automatic firing device operates a magnetic valve for the supply of gas instead of a magnetic valve in the oil supply circuit and vice versa. Thus it is not necessary to interchange any constructional components in order to change over from one mode of operation to the other. Owing to the special constructional nature of the burner having the pressure spray nozzle 30 situated behind the diaphragm opening 46 it is ensured that the nozzle can also be kept cool by the air stream even during gas operation, so that even with long term gas operation cracking of oil does not occur within the nozzle. Thus it is possible to change immediately from gas operation to oil operation. As with pure vaporization oil burners, the pressure on the packings 44 and 64 is determined by the spring 24. Since these packings are subjected to negligible internal pressure a relatively low bearing pressure is sufficient to ensure that even with packings between the plate edges 60 and 62 which are not completely hard a defined separation can be maintained. Insofar as it is necessary, it is also possible to provide rigid devices to maintain the separation, for example distance nubs pressed out from one of the plates and against which the other plate is applied.

Another way of establishing the separation between the two plates 40 and 56 with accuracy is by providing flanges 74 on the mountings of the ignition electrodes 52 and the ionization electrode 54 which determine the separation distance a and by which the electrodes can be mounted by clamping between the two plates.

In the embodiment illustrated in FIGS. 1 and 2, the mixing tube 48 is fixed by means of its mountings 76 to the plate 56.

The separation distance a between the two diaphragms 40 and 56 which limit the annular gas supply chamber 72 needs only to be a few millimeters and may for example lie between 2 and 4 mm. Together with the thickness of the plate 56, which may be about 1.5 mm, the geometrical relationships for the vaporization oil burner are only slightly changed. It has been shown by experiment that even with an annular gas supply chamber, the operating data for fuel oil operation can be maintained without difficulty.

With the burner described, equal efficiency can be achieved in both modes of operation.

The burner described can be operated in gas operation with gases of various types, for example natural gas or town gas or even bottled liquid gas, such as butane or propane.

Different calorific values can be taken into account by adjustment of the gas inflow opening and thus control of the amount of gas. In this case it is only necessary to provide a suitably adjusted plate 56 or a suitably designed mixing unit comprising both plates, the mixing tube 48 and the mounting 36 by means of which the mixing unit is fixed on to the nozzle rod.

Figure 3:
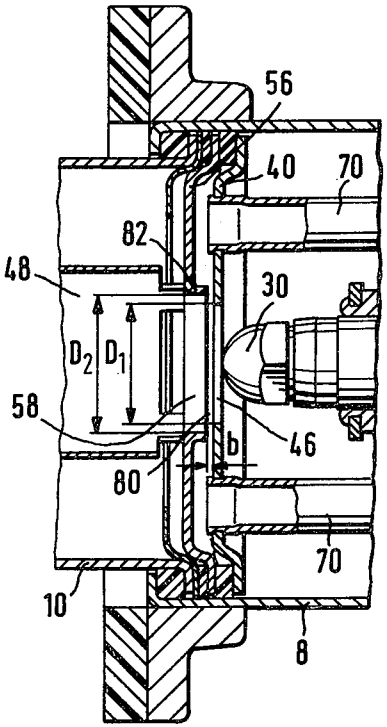
FIGS. 3 to 5 also show, in partial section in each case, other embodiments of the opening for inflow of gas at the internal circumference of the annular gas supply chamber.
Figure 4:
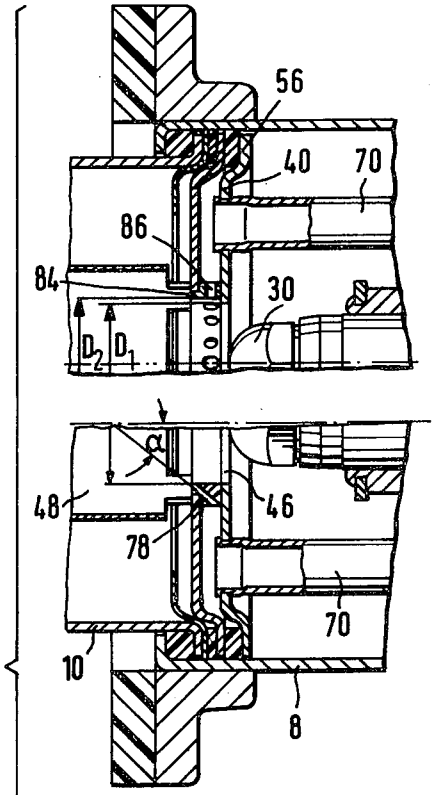
Figure 5:
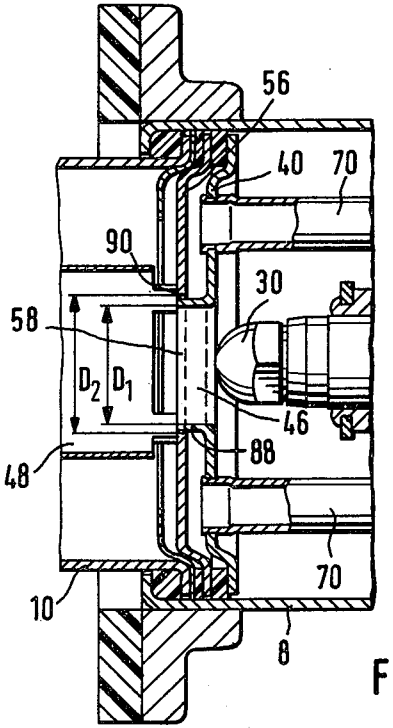

Special embodiments of the gas input openings are illustrated in FIGS. 3 to 5, which show embodiments which correspond to the design of the gas outlet openings of the previously described embodiment according to FIGS. 1 and 2.

In the embodiment according to FIG. 3, the edge of the plate opening 58 in the plate 56 is flanged in the upstream direction, so that the free end face 80 of the flange edge 82 spaced by distance b from the plate 40 determines the axial dimension of the circular input cross-section. In this embodiment it is possible to achieve relatively accurate input cross-sections for cross current operation, as is necessary for example in operation with gas under pressure. The edge 80 of the flange edge 82 may alternatively be situated immediately against the plate 40 where it is then possible for cut-outs to be provided in the edge, in each case, which limit the input cross-section together with the neighbouring surface of the plate 40.

In the embodiment according to FIG. 4, a ring 84 whose internal diameter is ≧ the diameter of the plate opening 46 in the plate 40 is clamped between the two plates 40 and 56. Radial gas exit bores 86 are provided in this ring 84 as is illustrated in FIG. 4 above the horizontal centre line. This embodiment is again suitable for cross current operation with gas under pressure. The bores may, however, as is shown in the lower half of FIG. 4 below the horizontal centre line, be inclined at an angle $\alpha$ to the axis of the nozzle, so that a mixed cross current—direct current operation is achieved. The exits of these bores 78 may here be situated on the inner circumference of the ring 84. They may however be arranged on a larger radius on the downstream front face of the ring 84.

In the embodiment according to FIG. 5, the edge of the plate opening 46 of the plate 40 is flanged in the downstream direction and, in particular, to such an extent that the edge 88 of the flange engages at least in part in the opening 58 in the plate 56. Thereby a coaxial annular aperture 90 is formed out of which the gas flows directly into the combustion air.

The embodiments described in the foregoing have the advantage that thetwo plates 40 and 56 can be manufactured from identical press blanks.

A burner exclusively designed to be operated by gaseous fuel, i.e. a burner solely utilized for gas burning, can also use the same constructional elements as for the oil burner or the combined oil-gas burner described in the foregoing. The burner solely for gas burning does not require the constructional components for oil operation, i.e. in particular the pressure spray nozzle 30 and the oil supply. Since in case of the oil burner and the combined burner for oil and gas operation the pressure spray nozzle positively influences the flow of air, it is advisable to provide an accordingly arranged and formed air conducting member for a burner solely for gas burning. Like the commercial pressure spray nozzles it can be provided with a cupola-shaped or semi-cupola-shaped end adjacent to the plate opening. The end may also be of conical or frusto-conical shape, in which case the apex of the cone may also be rounded. Even in case of this embodiment there is the advantage that the gas is burned in the flame tube belonging to the burner. In the heating chamber a heat exchange only takes place between the hot combustion gases leaving the flame tube and the walls of the heating chamber.

Since the same components are used for a burner solely for oil burning, a burner having oil or gas operation at will and a burner solely for gas burning, it is possible to achieve an important simplification in fabrication and storage in the manufacture of oil and gas burners by means of an embodiment of a burner according to the present invention solely for gas burning.

What I claim as my invention and desire to secure by Letters Patent of the United States is:

1. An oil burner for installation in heating and steam-raising boilers having an oil atomizer device, comprising a first plate located downstream of the oil atomizer device and having at least one opening formed therein that defines a passageway for atomized oil and further defining the sole passageway for combustion air, a mixing tube positioned coaxially with respect to the opening in said first plate and spaced downstream therefrom having a diameter greater than the diameter of a circle surrounding the passageway in said first plate; a flame tube coaxially surrounding said mixing tube and having a length such that combustion gases flowing downstream of said mixing tube are received against an inner wall of said flame tube, and downstream of said first plate, an annular chamber for the supply of gaseous fuel having gas outlet openings in the region of said at least one opening in said first plate, said annular chamber being formed by said first plate and a second plate spaced a short distance downstream of said first plate, and at least one gaseous fuel supply tube being mounted on the upstream side of said first plate.

2. An oil burner according to claim 1, said two plates being circular in configuration.

3. A burner according to claim 1, said two plates each having their outer circumferential edges offset axially and being sealed with one another at said outer circumferential edges.

4. A burner according to claim 3, sealing packings being positioned between said plates and determining the axial separation distances between said outer circumferential edges of said plates.

5. A burner according to claim 1, said gaseous fuel supply tube being mounted perpendicular to the plane of said first plate.

6. A burner according to claim 1, said second plate having an opening formed therein which is of larger diameter than the opening as formed in said first plate.

7. A burner according to claim 6, the edge of said opening in either said first or said second plate being flanged circumferentially in an axial direction, the end of said flange defining with the other plate a gas outlet opening.

8. A burner according to claim 1, a ring having gas outlet openings formed therein and being located between said first and second plates adjacent to said openings in said plates.

9. A burner according to claim 8, said ring having its internal circumference aligned with the opening in said first plate.

10. A burner according to claim 8, said ring having its internal circumference aligned with the opening in said second plate.

11. A burner according to claim 1, the profile of the peripheral edge of the opening in said first plate being toothed.

12. A burner according to claim 1, the profile of the peripheral edge of the opening in said first plate being serrated.

13. A burner according to claim 1, the opening as formed in said first plate being centrally located therein, said first plate having a plurality of air openings that are positioned around said opening and are positioned within a circular axial projection that is projected from the open upstream end of the mixing tube.

* * * * *